US010233006B2

(12) United States Patent
Liao et al.

(10) Patent No.: US 10,233,006 B2
(45) Date of Patent: Mar. 19, 2019

(54) AIRTIGHT SHEATH BEING ADJUSTABLE IN SIZE FOR PACKING

(71) Applicants: Tai-An Liao, Taipei (TW); Kao-Hsiung Liao, Taipei (TW)

(72) Inventors: Tai-An Liao, Taipei (TW); Kao-Hsiung Liao, Taipei (TW)

( * ) Notice: Subject to any disclaimer, the term of this patent is extended or adjusted under 35 U.S.C. 154(b) by 0 days.

(21) Appl. No.: 15/680,223

(22) Filed: Aug. 18, 2017

(65) Prior Publication Data

US 2019/0055075 A1 Feb. 21, 2019

(51) Int. Cl.

*B65D 81/03* (2006.01)
*B65D 85/30* (2006.01)
*B65D 81/05* (2006.01)

(52) U.S. Cl.

CPC ..... *B65D 81/052* (2013.01); *B65D 81/03* (2013.01); *B65D 85/30* (2013.01)

(58) Field of Classification Search

CPC ..... B65D 81/03; B65D 81/052; B65D 81/05; B65D 81/053; B65D 81/051; B65D 85/30
USPC ..... 206/522, 583, 586, 453, 454; 383/3
See application file for complete search history.

(56) References Cited

U.S. PATENT DOCUMENTS 7,631,762 B2 * 12/2009 Liao ..... B65D 81/052 206/522
7,681,734 B2 * 3/2010 Liao ..... B65D 81/052 206/522
2005/0263425 A1 * 12/2005 Tanaka ..... B65D 81/052 206/522
2015/0259121 A1 * 9/2015 Liao ..... B65D 81/05 206/521

* cited by examiner

*Primary Examiner* — Steven A. Reynolds
*Assistant Examiner* — Javier A Pagan

(57) ABSTRACT

An airtight sheath includes a first buffering unit, a second buffering unit, a bottom buffering unit, and a foldable unit. Two terminating sides are formed at opposite sides of the second buffering unit to be heat-sealed to two opposite sides of the first buffering body. A packing space is formed and surrounded by the first, second, and bottom buffering units. The foldable unit includes a bending body, and a plurality of abutting air columns. The bending body is bendable from the second buffering unit so that the foldable unit is foldable into the packing space, where the packing space is capable of being narrowed by the abutting air columns and the first buffering unit. The airtight sheath is capable of fittingly packing an object having a small size as the foldable unit is folded, or an object having a larger size as the foldable unit is unfolded.

7 Claims, 9 Drawing Sheets

AIRTIGHT SHEATH BEING ADJUSTABLE IN SIZE FOR PACKING

BACKGROUND OF THE INVENTION

1. Field of the Invention

The present invention relates to a buffering sheath, and particularly to an airtight sheath being adjustable in size for packing various shapes of objects.

2. Related Art

With the vigorous development of the technical industry, electronic and telecommunication products, such as smart phones, tablets, laptops, and flat LCD TV sets, become more and more exquisite in terms of structure. For ensuring the integrity of these products throughout their packing, transport and delivery, packing materials play an important role. In early days, foam and other soft, loose material were placed in cartons for providing buffering protection. However, their effects are limited as they are unable to be uniformly arranged and they tend to scatter around.

To overcome the foregoing shortcomings, some packing dealers started to use an inflatable air pack as cushioning material. Such an inflatable air pack has a sheet-like shape constructed with a plurality of air columns. In packing, lots of the inflatable air packs are to be placed around an object and to try to stuff the space in a carton in order to protect the object inside. Even though the air packs are arranged in a form in the carton more integral than that of traditional form packing materials, the multiple air packs still remain scattered in the carton. Besides, conventional air packs fail to protect electrical products or other objects during the process of loading objects into the carton because of the sheet-like shape of conventional air packs. That is, electrical products or objects are highly exposed to the risk of impact during loading or delivery to be loaded. Furthermore, electrical products, such as, tablets, lap tops or game consoles are varied in sizes, while conventional air packs are not designed to be adjustable in sizes to fit different widths or lengths of electrical products. In other words, it may need more packing materials to stuff the carton, or more cartons of different sizes are required for different sizes of packing materials, which all result in an inconvenient, troublesome, and a higher cost of packing.

SUMMARY OF THE INVENTION

Accordingly, an object of the present invention is to provide an airtight sheath which is adjustable in size for packing objects of different sizes and for providing sound protection for the objects.

To achieve the above-mentioned object, the airtight sheath, which is made of at least two outer films being heat-sealed together, comprises a first buffering unit comprising a plurality of first air columns. A second buffering unit comprises a plurality of second air columns arranged apart from the first air columns, and two terminating sides formed at opposite sides of the second buffering unit, the terminating sides being heat-sealed to two opposite sides of the first buffering body. A bottom buffering unit comprises a plurality of bottom air columns, two opposite sides of the bottom buffering unit integrally respectively connecting the first and second buffering units such that the bottom air columns correspondingly communicating with the first air columns and the second air columns to enable air to flow thereamong, the first, second, and bottom air columns cooperatively surrounding to form a packing space therein. A foldable unit integrally extends from one side of the second buffering unit opposite to the bottom buffering unit, and comprises a bending body, and a plurality of abutting air columns extending from and communicating with the bending body, the bending body being bendable from the second buffering unit so that the foldable unit is foldable into the packing space, where the packing space is capable of being narrowed by the abutting air columns and the first buffering unit.

In one aspect of the present invention, the foldable unit further comprises a plurality of foot air columns connected to ends of the abutting air columns opposite to the bending body, and the foot air columns are being propped against the first buffering unit and bend toward the abutting air columns when the foldable unit is folded into the packing space.

In another aspect of the present invention, the airtight sheath further comprises a suspending layer located in the packing space, one end of the suspending layer is heat-sealed to a top of the first buffering unit, and another end of the suspending layer is heat-sealed to a top of the second buffering unit, and the foot air columns abut onto a bottom of the suspending layer when the foldable unit is folded in the packing space.

In another aspect of the present invention, the foldable unit further comprises two deflated portions formed at opposite end portions of the foldable unit and being flush and terminated with the terminating sides of the second buffering body, and the deflated portions are heat-sealed to be laminated so as to facilitate folding of the foldable unit.

In another aspect of the present invention, any two of the adjacent second air columns are further provided with a narrowing sealing line, which is heat-sealed with the first buffering unit to further narrow the packing space.

The airtight sheath of the present invention utilizes either the foldable unit which is foldable into the packing space or the narrowing sealing line to adjust the size of the packing space, so as to fit and tightly package an object having a smaller size. As the foldable unit is unfolded, the packing space is capable of packing an object having a larger size. In this manner, one airtight sheath of the present invention is capable of packing different sizes of objects, and therefore there is no need to provide various sizes of packing materials for packing objects of different sizes, whereby successfully overcoming the problem of high manufacturing costs and inconvenience arising from traditional packing materials that are incapable of being adjusted in size for packing objects.

DESCRIPTION OF THE PREFERRED EMBODIMENTS

The present invention discloses an airtight sheath 10, which is made of two outer films 101 and 102 being heat-sealed together, and is capable of being rapidly inflated to forma three-dimensional buffering structure with an adjustable packing space 100 therein for packing an object 6 and protecting it from being damaged by external impact. The object 6 is, for example, a lap top, a tablet, or a display pane.

Figure 1:
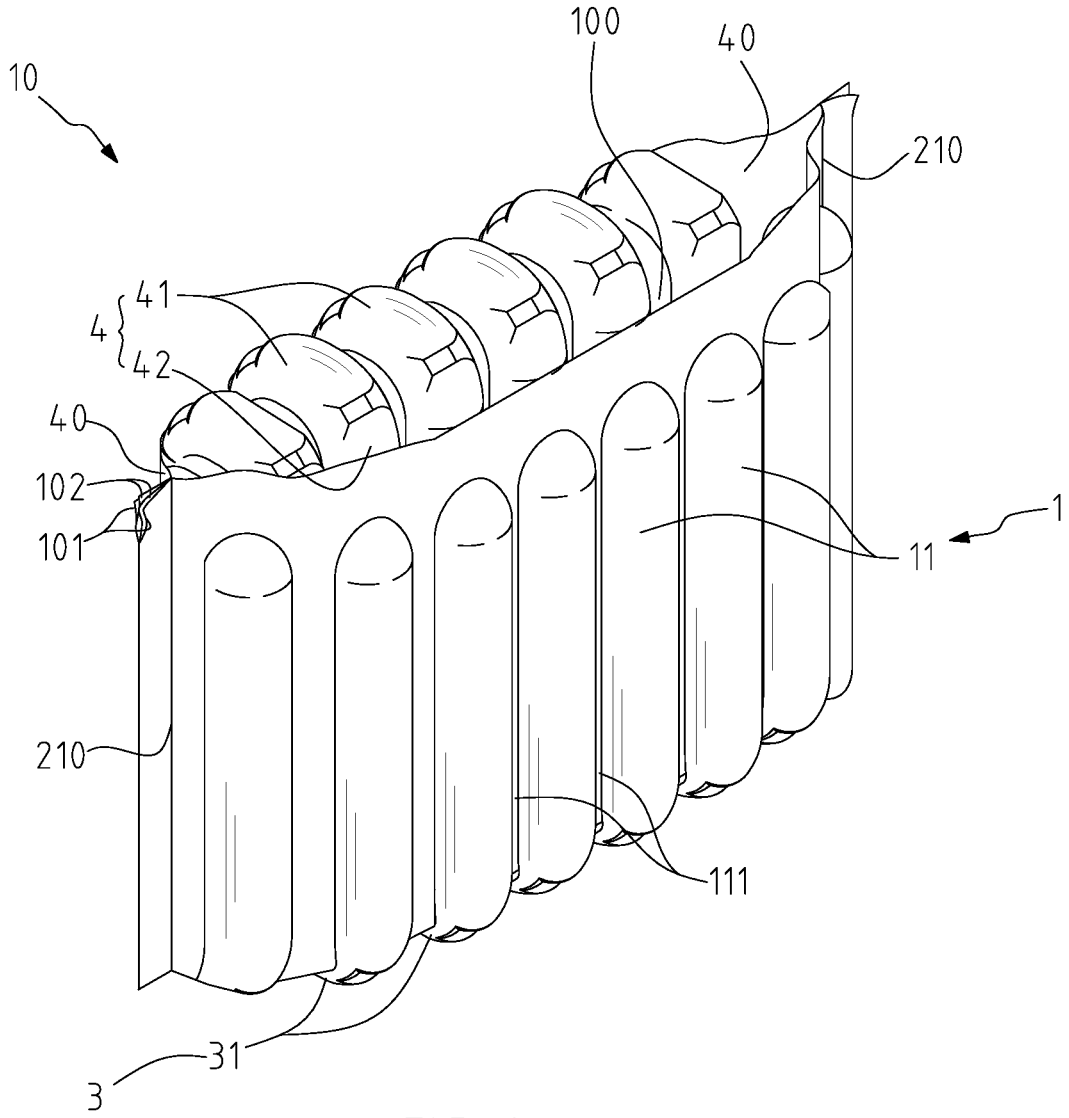
FIG. 1 is a front, top perspective view of an airtight sheath of the present invention.
Figure 2:
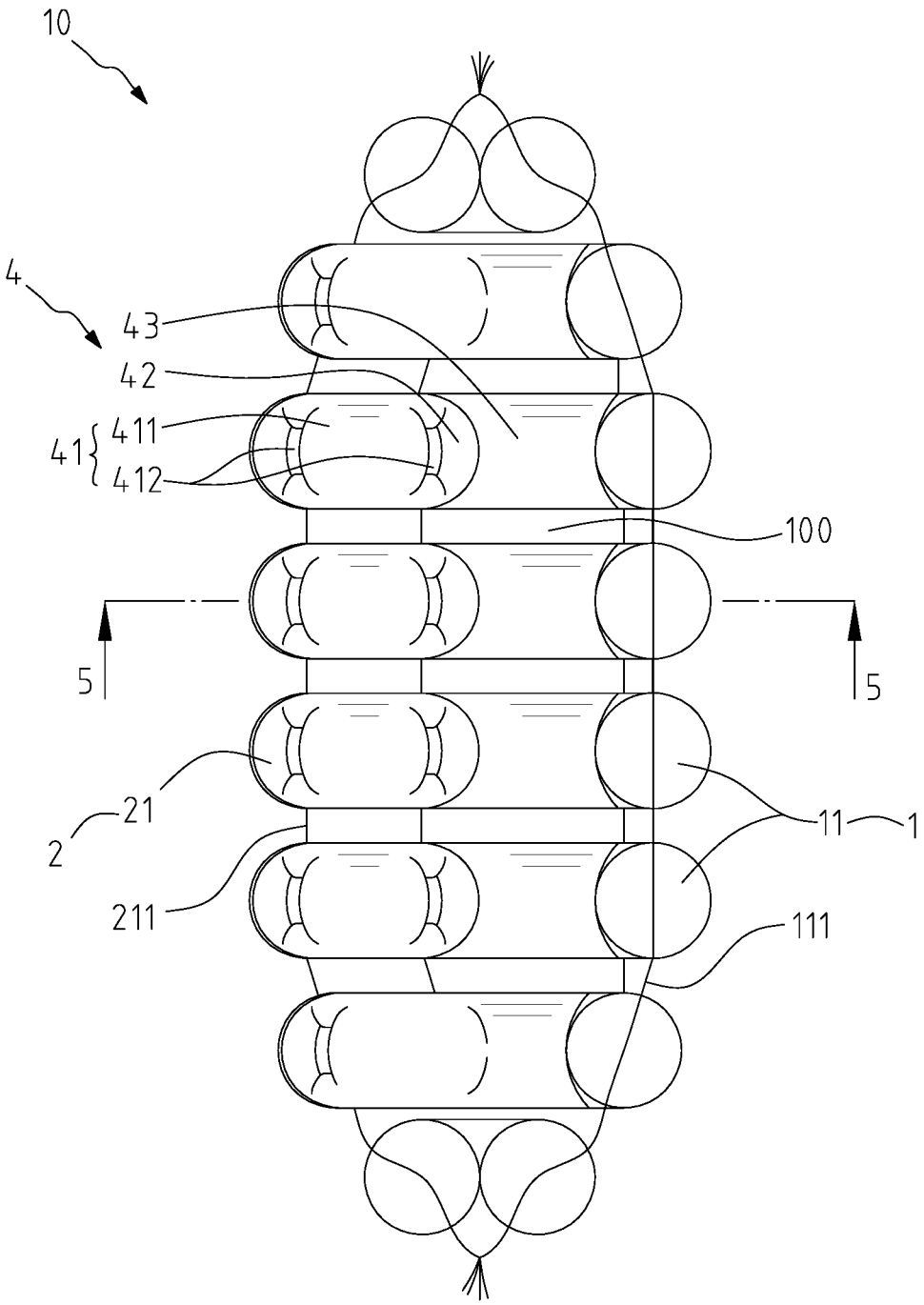
FIG. 2 is a top plan view of the airtight sheath of FIG. 1.
Figure 3:
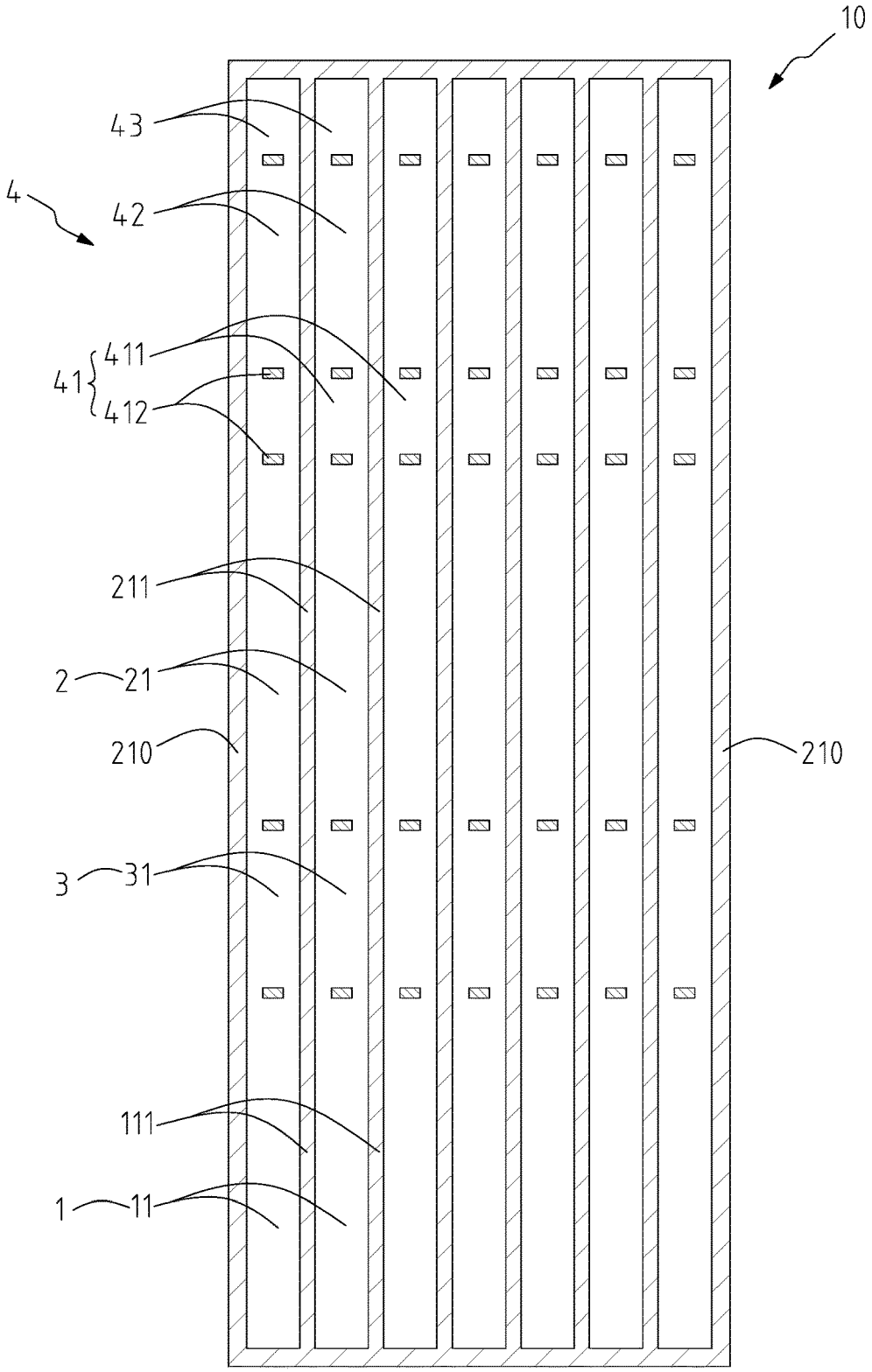
FIG. 3 is a schematic expanded view of FIG. 1.

Referring to FIGS. 1 to 3 showing a preferable embodiment of the airtight sheath of the present invention, the airtight sheath 10 comprises a first buffering unit 1, a second buffering unit 2, a bottom buffering unit 3, and a foldable unit 4. The first buffering unit 1 comprises a plurality of first air columns 11 arranged abreast with an interval sealing line 111 being heat-sealed between each two of the first air columns 11. The second buffering unit 2 comprises a plurality of second air columns 21 arranged abreast with an interval sealing line 211 being heat-sealed between each two of the second air columns 21. Two terminating sides 210 are formed at opposite sides of the second buffering unit 2 and are heat-sealed to two opposite sides of the first buffering body 1.

Figure 4:
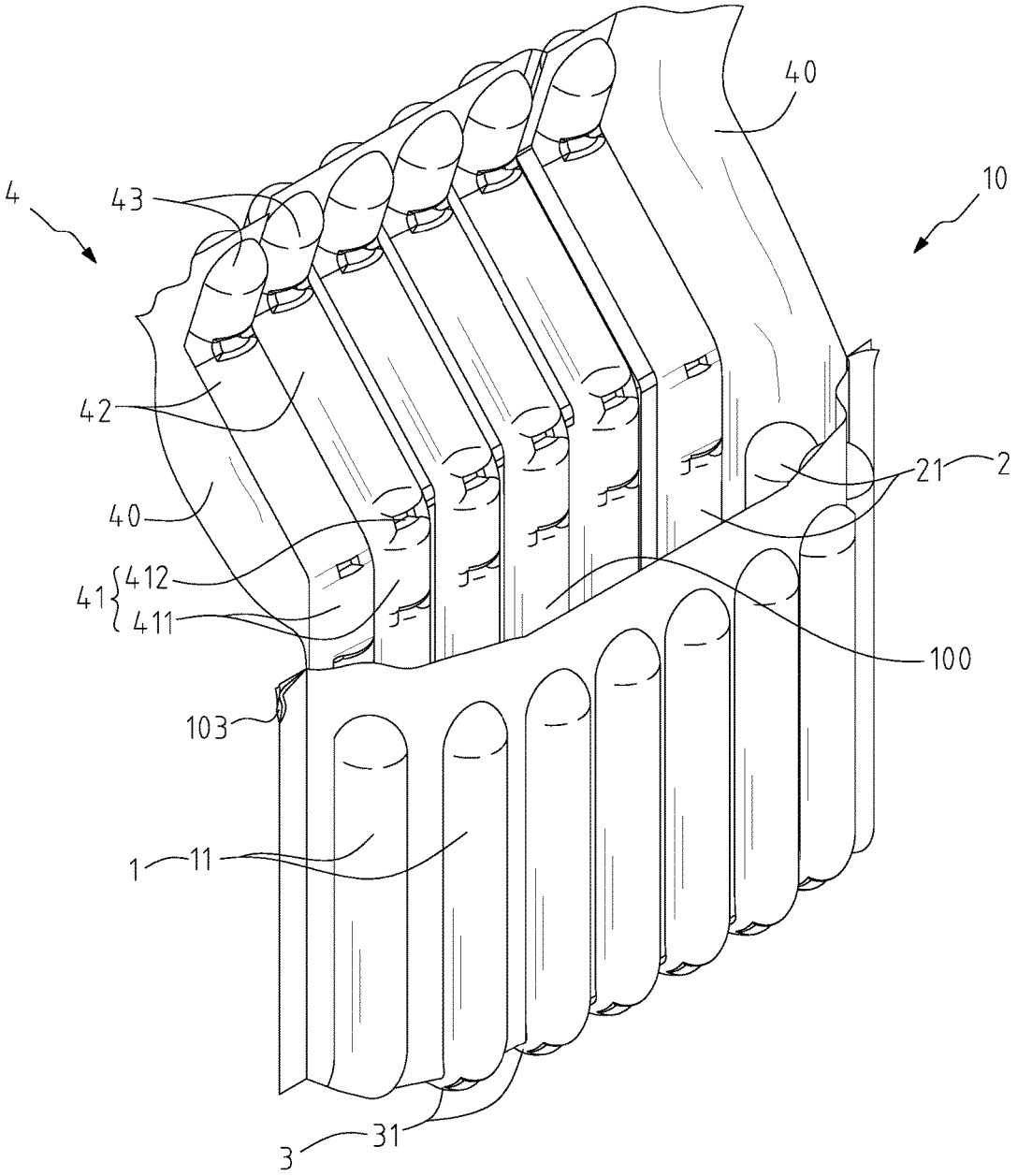
FIG. 4 is a schematic perspective view of the airtight sheath showing a foldable body is unfolded.
Figure 5:
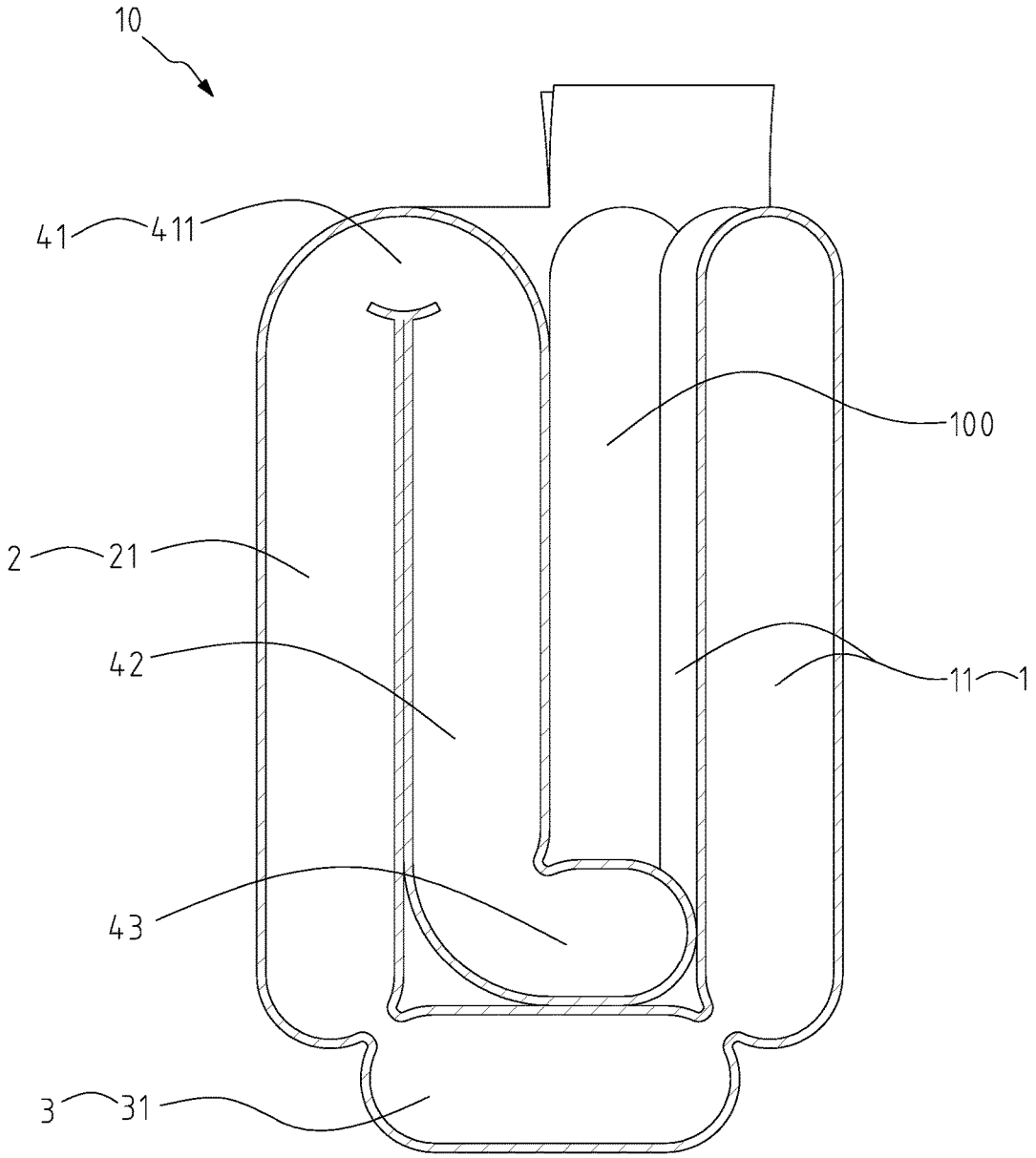
FIG. 5 is a schematic cross-sectional view taken along line 5-5 of FIG. 2.
Figure 8:
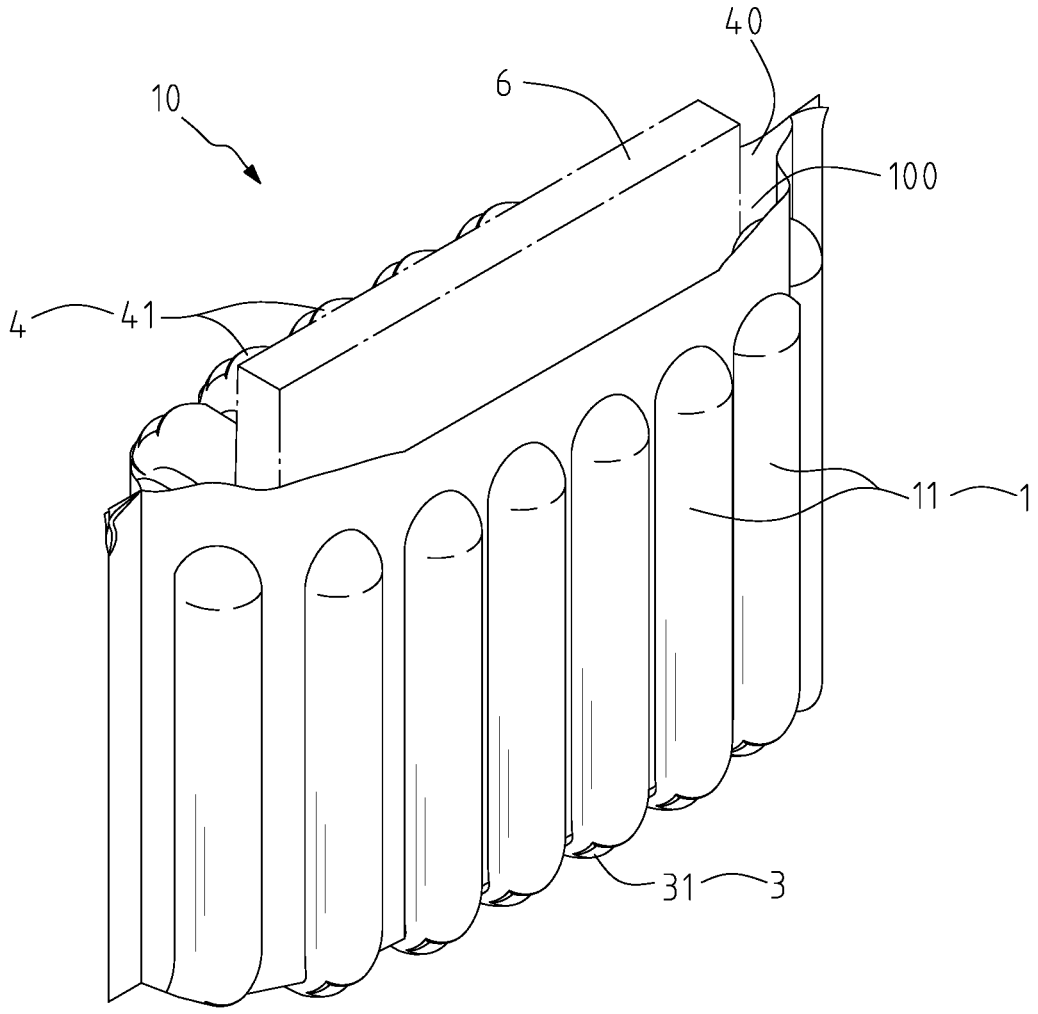
FIG. 8 is a schematic perspective view showing the airtight sheath in a state of use.

As shown in FIGS. 4 and 5, the bottom buffering unit 3 comprises a plurality of bottom air columns 31 arranged abreast. Two opposite sides of the bottom buffering unit 3 integrally respectively connect the first and second buffering units 1 and 2 such that the bottom buffering unit 3, the first and second buffering units 1 and 2 cooperatively form a substantially U shape and cooperatively surround to form the packing space 100 therein, where the bottom air columns 31 correspondingly communicate with the first air columns 11 and the second air columns 21 to enable air to flow thereamong. Specifically, the two outer films 101 and 102 extend upward of the first buffering unit 1 so as to form an air inflation channel 103 located above and along the plurality of first air columns 11 (as shown in FIG. 4), whereby air is to flow from the air inflation channel 103 to the first, second, and bottom air columns 11, 21 and 31 to inflate the airtight sheath 10. In this manner, the object 6 is capable of being packaged into the packing space 100 of the airtight sheath 10 and protected by the airtight sheath 10 (as shown in FIG. 8).

Further referring to FIGS. 1 and 4, it is noted that a size of the packing space 100 is adjustable by the foldable unit 4. The foldable unit 4 integrally extends from and communicates with one side of the second buffering unit 2 opposite to the bottom buffering unit 3. The foldable unit 4 comprises a bending body 41, a plurality of abutting air columns 42, and a plurality of foot air columns 43. The bending body 41 is bendable from the second buffering unit 2 so that the foldable unit 4 is foldable into the packing space 100. The bending body 41 comprises a plurality of bending air columns 411 which communicate with the second buffering unit 2, each of the bending air columns 411 has two opposite bending sides 412, one of the bending sides 412 is partially heat-sealed with a corresponding one of the second air columns 21, and the other one of the bending sides 412 is partially heat-sealed with a corresponding one of the abutting air columns 42. The plurality of abutting air columns 42 extend from and communicate with the bending air columns 411 and the foot air columns 43. As shown in FIG. 1, the size of the packing space 100 is narrowed by the bending air columns 411 and the abutting air columns 42 when the foldable unit 4 is folded in the packing space 100. Therefore, the object 6 having a small size and thickness is capable of being suitably tightly packed and positioned in the packing space 100 (as shown in FIG. 8). Particularly, the juncture of the second buffering unit 2 and the foldable unit 4 is protected by the bending air columns 411 after the foldable unit 4 is folded into the packing space 100.

Figure 9:
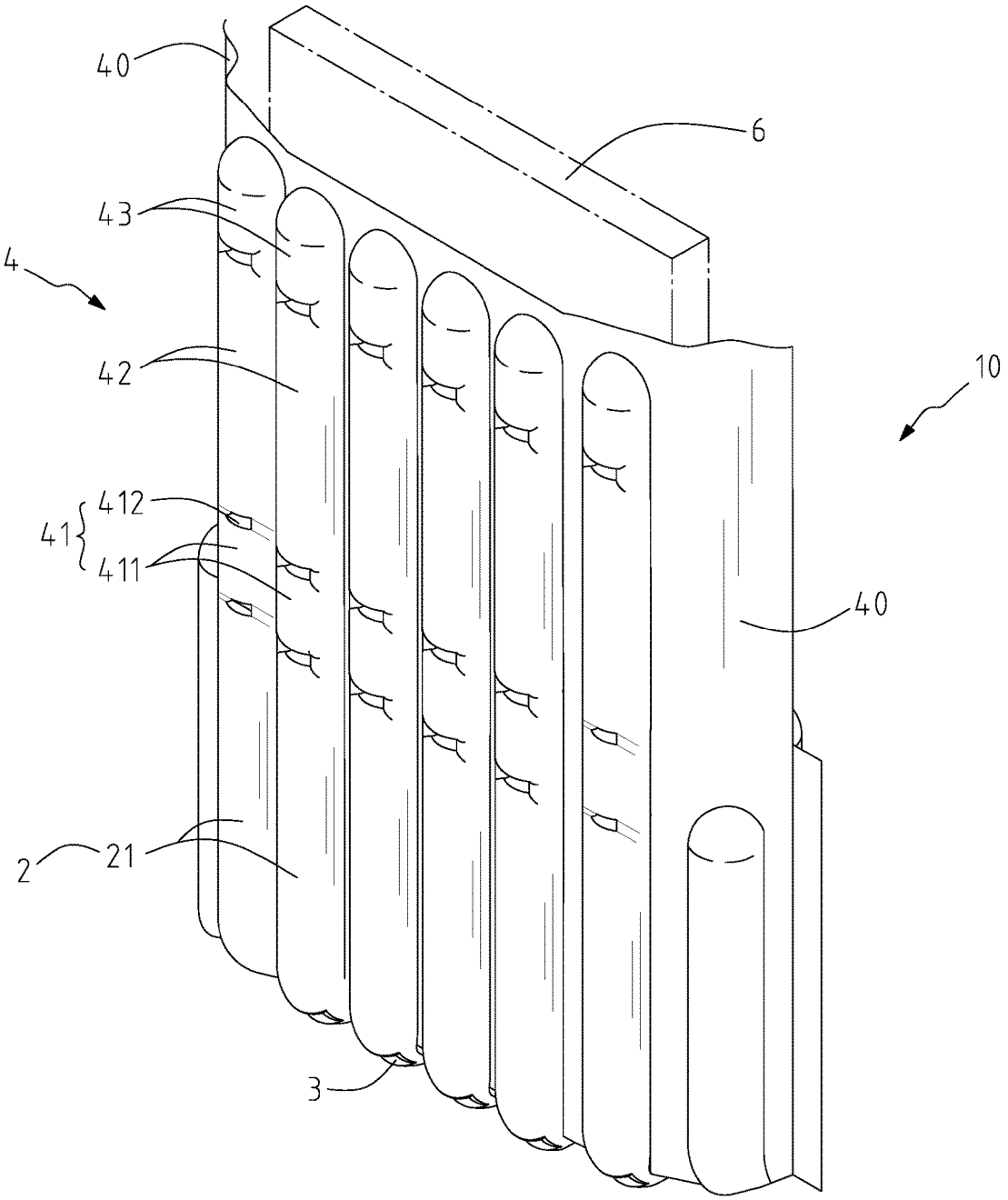
FIG. 9 is a schematic perspective view showing the airtight sheath in another state of use where the foldable unit is unfolded.

Likewise, as the foldable unit 4 is unfolded, the packing space 100 is also capable of accommodating an object 6 having a different size, i.e. a size of grater thickness or length, and the foldable unit 4 is capable of remaining straight and abutting onto the object 6 so as to expand the area of side protection for the object 6, as shown in FIG. 9.

Continuing referring to FIGS. 1 and 4, the plurality of foot air columns 43 are connected to ends of the abutting air columns 42 opposite to the bending body 41. The foot air columns 43 are bendable from the abutting air columns 42. In the process of folding the foldable unit 4 into the packing space 100, the foot air columns 43 are being propped against the first buffering unit 1 and bend toward the abutting air columns 42 (as shown in FIG. 5), whereby abutting and supporting a bottom of the object 6. In other words, the foot air columns 43 enhance protection efficacy for a bottom of the airtight sheath 10. In the preferable embodiment, as shown in FIGS. 3 and 4, each of the abutting air columns 42 has a length shorter than that of each of the second air columns 21, so that the abutting air columns 42 completely abut onto a side of the second buffering unit 2 in the packing space 100 for enhancing side protection of the airtight sheath 10. Furthermore, each of the foot air columns 43 has a length shorter that of the bottom air column 31 so as to facilitate folding of the foldable unit 4.

Referring back to FIG. 1, the foldable unit 4 further comprises two deflated portions 40 formed at opposite end portions of the foldable unit 4 and being flush and terminated with the terminating sides 210 of the second buffering body 2. Specifically, the deflated portions 40 are defined by the two bending air columns 411 and the two abutting air columns 42 at the opposite outermost sides of the foldable unit 4 and are not inflated (as shown in FIG. 4). The deflated portions 40 are heat-sealed to be laminated so as to facilitate folding of the foldable unit 4.

Figure 6:
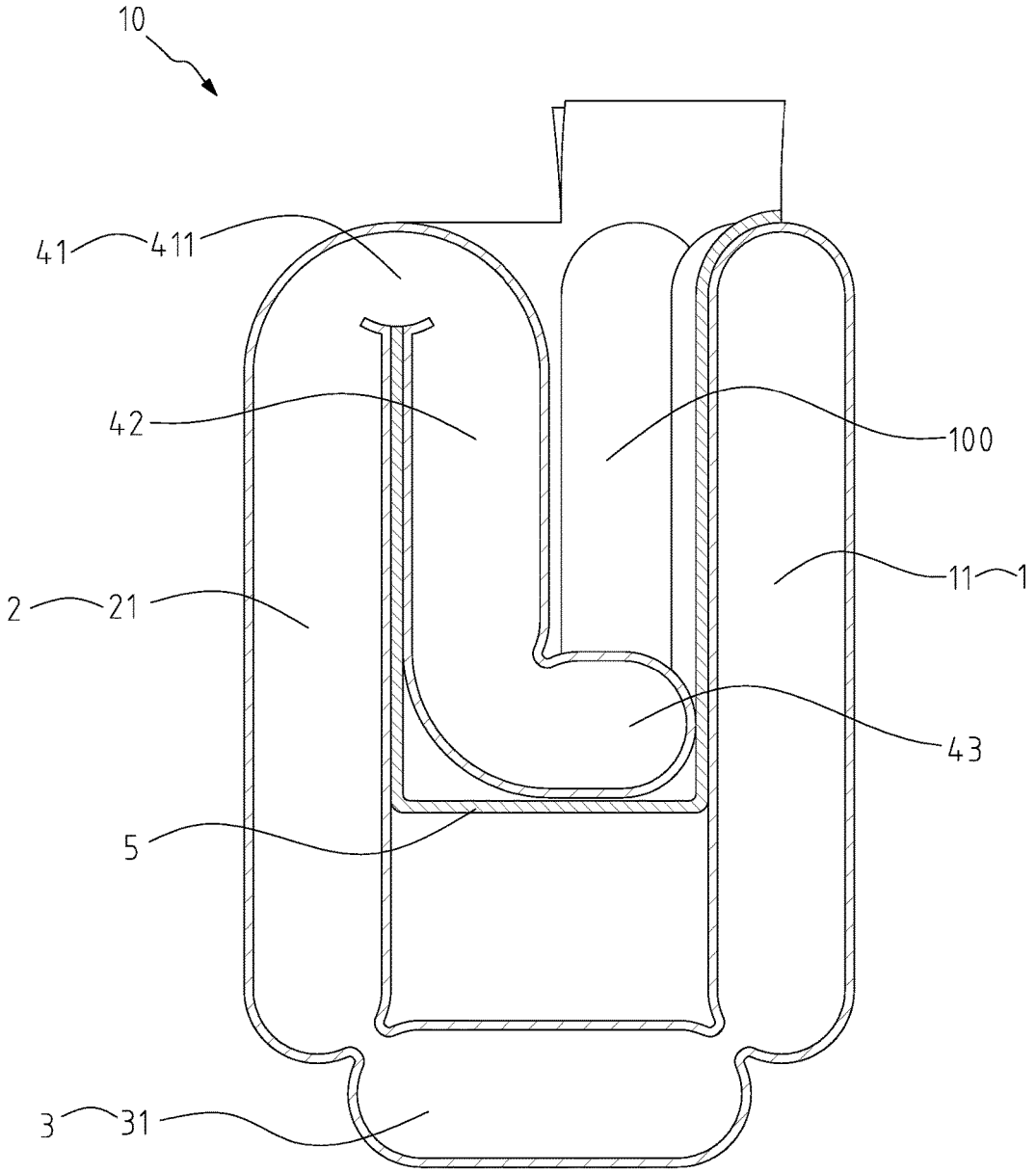
FIG. 6 is a schematic cross-sectional view of the airtight sheath which is further provided with a suspending layer.

Referring to FIG. 6, the airtight sheath 10 further provides a suspending layer 5 located in the packing space 100. One end of the suspending layer 5 is heat-sealed to a top of the first buffering unit 1, and another end of the suspending layer 5 is heat-sealed to a top of the second buffering unit 2, such that the suspending layer 5 forms a U-shaped configuration in cross section where a bottom of the suspending layer 5 is spaced apart from the bottom buffering unit 3. Specifically, the foot air columns 43 abut onto the bottom of the suspending layer 5 as the foldable unit 4 is folded in the packing space 100. In this manner, the object 6 is well protected by the airtight sheath 10, and particularly, when the object 6 is placed in the packing space 100, the weight of the object 6 applied on the suspending layer 5 forces the first and second buffering units 1 and 2 to be drawn toward the object 6 by the suspending layer 5. As a result, the object 6 is tightly held by the airtight sheath 10. Furthermore, the suspending layer 5 is spaced apart from the bottom buffering unit 3, where the impact on the bottom of the airtight sheath 10 can be effectively withstood by the bottom air columns 31, the space between the suspending layer 5 and the bottom buffering unit 3, and the foot air columns 43 in order.

Figure 7:
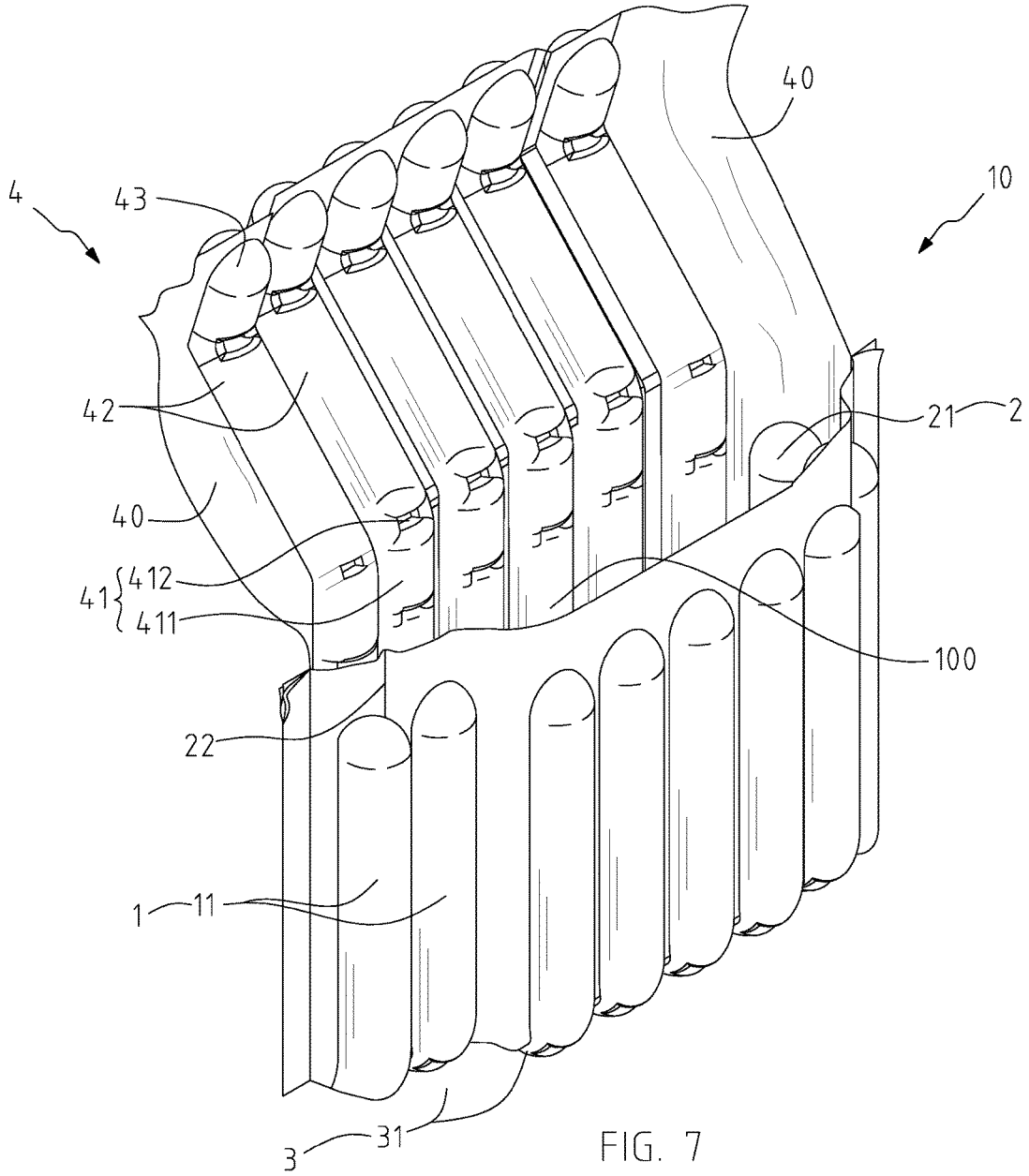
FIG. 7 is a rear, top perspective view showing a side portion of the airtight sheath is further heat-sealed to narrow a packing space.

Referring to FIG. 7 illustrating a further application of the airtight sheath 10 for packing an object having a narrower width, any two of the adjacent second air columns 21 are capable of being provided with a narrowing sealing line 22, which is defined as one of the interval sealing line 211 and is heat-sealed with the first buffering unit 1 to further narrow the packing space 100. Therefore, the packing space 100 being reduced is more suitable for an object having a narrow width.

Accordingly, the airtight sheath 10 of the present invention utilizes either the foldable unit 4 which is foldable into the packing space 100 or the narrowing sealing line 22 to adjust the size of the packing space 100, so as to fit and tightly package an object 6 having a smaller size. As the foldable unit 4 is unfolded, the packing space 100 is capable of packing an object 6 having a greater size. In this manner, a single airtight sheath 10 of the present invention is capable of packing different sizes of objects 6, and therefore there is no need to provide various sizes of packing materials for packing objects of different sizes. Therefore, the airtight sheath 10 of the present invention successfully overcomes the problem of highly manufacturing costs and inconvenience arising from traditional packing materials that are incapable of being adjusted in size for packing objects.

It is understood that the invention may be embodied in other forms within the scope of the claims. Thus the present examples and embodiments are to be considered in all respects as illustrative, and not restrictive, of the invention defined by the claims.

What is claimed is:

1. An airtight sheath being adjustable in size for packing and made of at least two outer films heat-sealed together, the airtight sheath comprising:

a first buffering unit comprising a plurality of first air columns;

a second buffering unit comprising a plurality of second air columns arranged apart from the first air columns, and two terminating sides formed at opposite sides of the second buffering unit, the terminating sides being heat-sealed to two opposite sides of the first buffering body;

a bottom buffering unit comprising a plurality of bottom air columns, two opposite sides of the bottom buffering unit integrally respectively connecting the first and second buffering units such that the bottom air columns correspondingly communicating with the first air columns and the second air columns to enable air to flow thereamong, the first, second, and bottom air columns cooperatively surrounding to form a packing space therein; and a foldable unit integrally extending from one side of the second buffering unit opposite to the bottom buffering unit, and comprising a bending body, and a plurality of abutting air columns extending from and communicating with the bending body, the bending body being bendable from the second buffering unit so that the foldable unit is foldable into the packing space, where the packing space is capable of being narrowed by the abutting air columns and the first buffering unit;

wherein the foldable unit further comprises a plurality of foot air columns connected to ends of the abutting air columns opposite to the bending body, and the foot air columns are being propped against the first buffering unit and bend toward the abutting air columns when the foldable unit is folded into the packing space.

2. The airtight sheath of claim 1, wherein each of the abutting air columns has a length shorter than that of each of the second air columns, so that the abutting air columns completely abut onto a side of the second buffering unit in the packing space for enhancing side protection of the airtight sheath.

3. The airtight sheath of claim 1, further comprising a suspending layer located in the packing space, one end of the suspending layer is heat-sealed to a top of the first buffering unit, and another end of the suspending layer is heat-sealed to a top of the second buffering unit, and the foot air columns abut onto a bottom of the suspending layer when the foldable unit is folded in the packing space.

4. The airtight sheath of claim 1, wherein the foldable unit further comprises two deflated portions formed at opposite end portions of the foldable unit and being flush and terminated with the terminating sides of the second buffering body, and the deflated portions are heat-sealed to be laminated so as to facilitate folding of the foldable unit.

5. The airtight sheath of claim 1, wherein any two of the adjacent second air columns are further provided with a narrowing sealing line, which is heat-sealed with the first buffering unit to further narrow the packing space.

6. The airtight sheath of claim 1, further comprising a suspending layer located in the packing space, one end of the suspending layer is heat-sealed to a top of the first buffering unit, and another end of the suspending layer is heat-sealed to a top of the second buffering unit, such that the suspending layer forms a U-shaped configuration in cross section where a bottom of the suspending layer is spaced apart from the bottom buffering unit.

7. The airtight sheath of claim 1, wherein the two outer films extend upward of the first buffering unit so as to form an air inflation channel located above and along the plurality of first air columns, whereby air is to flow from the air inflation channel to inflate the entire the airtight sheath.

* * * * *